US011428427B2

(12) United States Patent
Ben-Gal Nguyen et al.

(10) Patent No.: US 11,428,427 B2
(45) Date of Patent: Aug. 30, 2022

(54) SYSTEMS AND METHODS FOR PREDICTING HVAC FILTER CHANGE USING TEMPERATURE MEASUREMENTS

(71) Applicant: 3M INNOVATIVE PROPERTIES COMPANY, St. Paul, MN (US)

(72) Inventors: Nitsan Ben-Gal Nguyen, Apple Valley, MN (US); Saber Taghvaeeyan, Maple Grove, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 17/339,372

(22) Filed: Jun. 4, 2021

(65) Prior Publication Data

US 2021/0293434 A1 Sep. 23, 2021

Related U.S. Application Data

(63) Continuation of application No. 16/758,351, filed as application No. PCT/IB2018/058169 on Oct. 19, 2018, now Pat. No. 11,060,747.

(60) Provisional application No. 62/576,165, filed on Oct. 24, 2017.

(51) Int. Cl.

| | |
|---|---|
| ***F24F 11/39*** | (2018.01) |
| ***F24F 11/61*** | (2018.01) |
| ***F24F 11/38*** | (2018.01) |
| ***F24F 11/63*** | (2018.01) |
| ***F24F 120/10*** | (2018.01) |
| ***F24F 11/64*** | (2018.01) |
| ***F24F 110/10*** | (2018.01) |

(52) U.S. Cl.

CPC ..... *F24F 11/39* (2018.01); *F24F 11/38* (2018.01); *F24F 11/61* (2018.01); *F24F 11/63* (2018.01); *F24F 11/64* (2018.01); *F24F 2110/10* (2018.01); *F24F 2120/10* (2018.01)

(58) Field of Classification Search

CPC .... F24F 3/16; F24F 11/00; F24F 11/30; F24F 11/63; F24F 11/64; F24F 2110/50; F24F 2110/52; F24F 2120/10; F24F 2130/00; F24F 2130/10

See application file for complete search history.

(56) References Cited

U.S. PATENT DOCUMENTS 5,833,134 A 11/1998 Ho
6,319,114 B1 * 11/2001 Nair ..... H05K 7/20181 96/420
6,507,282 B1 * 1/2003 Sherwood ..... B01D 46/0086 55/307

(Continued)

FOREIGN PATENT DOCUMENTS

EP 1054313 9/2002
WO WO-2007040276 A1 * 4/2007 ..... F24F 13/28

(Continued)

OTHER PUBLICATIONS

International Search Report for PCT International Application No. PCT/IB2018/058169, dated Feb. 12, 2019, 8 pages.

*Primary Examiner* — Ronald D Hartman, Jr.
(74) *Attorney, Agent, or Firm* — Kenneth B. Wood

(57) ABSTRACT

Systems and methods for estimating a replacement status of an air filter in an HVAC system, based on obtaining data correlated with the temperature of air outputted by the HVAC system as a function of time.

20 Claims, 5 Drawing Sheets

(56) References Cited

U.S. PATENT DOCUMENTS 6,993,414 B2 1/2006 Shah
9,723,380 B2 8/2017 Patel
10,281,166 B1 5/2019 Hutz
2001/0045159 A1* 11/2001 Johnson ..... B01D 46/58 95/26
2003/0070544 A1* 4/2003 Mulvaney ..... B01D 46/44 96/417
2004/0035125 A1* 2/2004 Ishida ..... F24F 11/30 62/132
2005/0043858 A1* 2/2005 Gelman ..... H02J 13/00004 700/286
2005/0150382 A1* 7/2005 Sheehan ..... B01D 46/22 96/429
2006/0130497 A1* 6/2006 Kang ..... B60H 3/06 62/127
2006/0186214 A1* 8/2006 Simon ..... G05D 23/1934 236/1 C
2006/0196953 A1* 9/2006 Simon ..... F24D 19/1096 236/46 R
2007/0144354 A1* 6/2007 Muller ..... B01D 46/0086 96/417
2008/0242212 A1 10/2008 El-Galley
2008/0315000 A1* 12/2008 Gorthala ..... G05D 22/02 236/94
2010/0163633 A1 7/2010 Barrett
2011/0112701 A1 5/2011 Johnson
2011/0198404 A1 8/2011 Dropmann
2012/0319851 A1* 12/2012 Hoglund ..... F24F 11/30 340/607
2012/0323375 A1* 12/2012 Dean-Hendricks ..... F24F 8/10 700/276
2014/0133097 A1* 5/2014 Kuramitsu ..... F04D 29/703 415/17
2014/0190240 A1* 7/2014 He ..... H05K 7/20209 73/38
2015/0260424 A1 9/2015 Fadell
2015/0330650 A1 11/2015 Abiprojo
2016/0178228 A1 6/2016 Shahabdeen

FOREIGN PATENT DOCUMENTS

WO WO 2016-089688 6/2016
WO WO 2018-031403 2/2018
WO WO 2018-031406 2/2018

* cited by examiner

SYSTEMS AND METHODS FOR PREDICTING HVAC FILTER CHANGE USING TEMPERATURE MEASUREMENTS

BACKGROUND

Heating, ventilation, and air conditioning (HVAC) systems are commonly used to control temperature in the interior space of various dwellings, such as e.g. homes and office buildings. With many HVAC installations, a disposable or recyclable air filter is conventionally employed. After a period of use, such a filter should be replaced for optimum performance.

Filter manufacturers often recommend replacement of the filter on a regular, fixed calendar-interval basis. This fixed period of time, however, may not be appropriate for all situations, in particular for demand-operation HVAC systems (typically employed with residential homes and light commercial dwellings) in which the HVAC system's fan only runs (and thus airflow passes through the air filter) during the times when the HVAC system is actively heating or cooling. Under these circumstances, the actual runtime of the HVAC system over the course of the fixed calendar period of time will often vary, e.g. with the season of the year. As a result, the fixed period for filter replacement may be too short or too long relative to an optimum replacement schedule based on the actual runtime experienced by the filter.

SUMMARY

In broad summary, herein are disclosed systems and methods for estimating a replacement status of an air filter in an HVAC system, based on obtaining data correlated with the temperature of air outputted by the HVAC system as a function of time. These and other aspects will be apparent from the detailed description below. In no event, however, should this broad summary be construed to limit the claimable subject matter, whether such subject matter is presented in claims in the application as initially filed or in claims that are amended or otherwise presented in prosecution.

DETAILED DESCRIPTION

Figure 1:
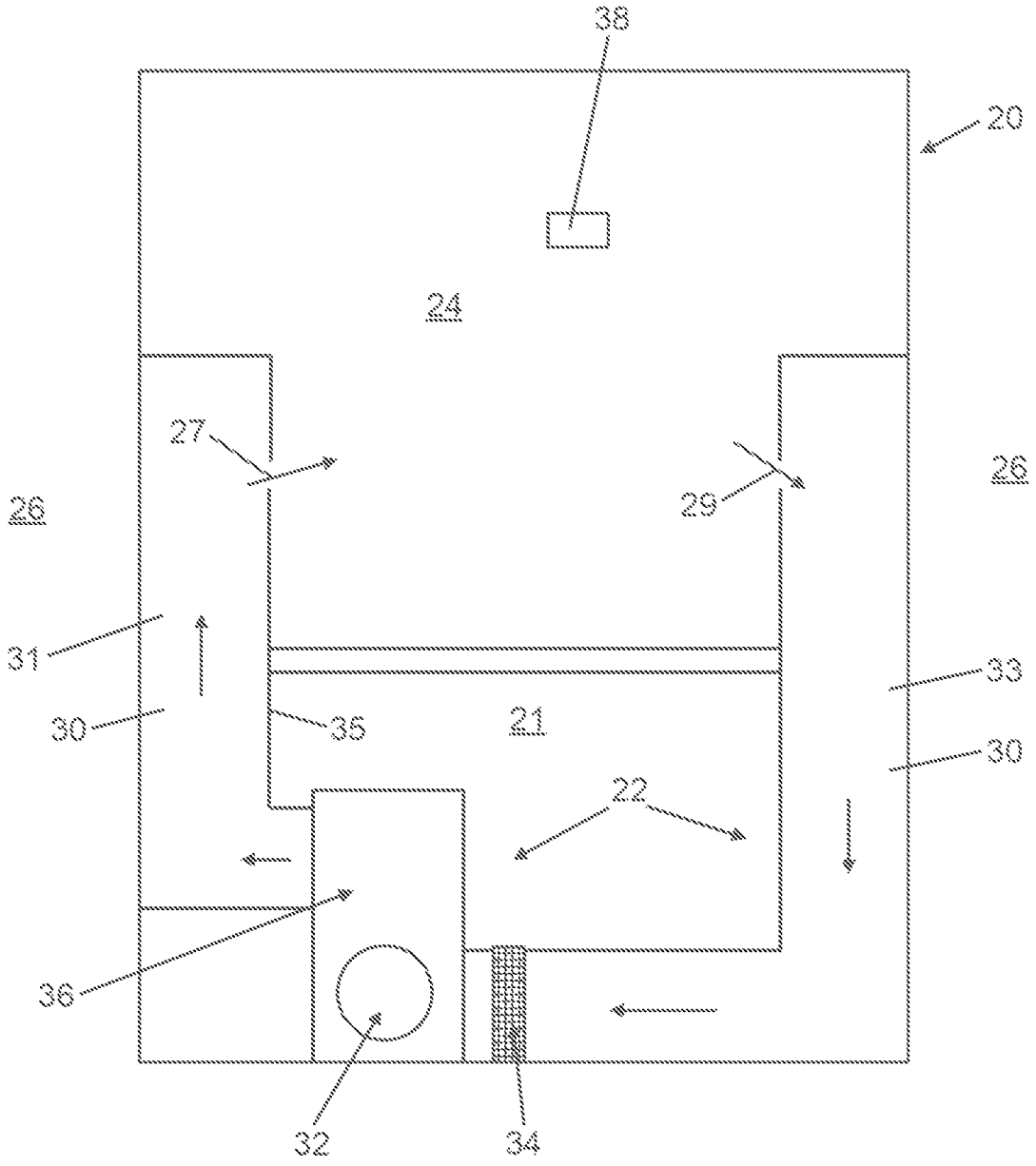
FIG. 1 is a schematic view, in generic representation, of an illustrative HVAC system that services a dwelling.

The present disclosure relates to systems and methods for estimating or predicting HVAC air filter replacement status and optionally reporting a need to replace the filter (and/or providing information regarding to the remaining usable filter life) to a user. The systems and methods can be employed with virtually any type of HVAC installation, but are particularly beneficial with existing, forced air HVAC systems operating on a demand basis (i.e., systems whose fan (blower) operates when the system is in cooling or heating mode) such as those commonly found in residential or light commercial dwellings. As a point of reference, FIG. 1 schematically illustrates a dwelling 20 having an installed HVAC system 22 (referenced generally). Conventionally, a structure of the dwelling 20 establishes an interior 24, commonly referred to as "indoor" or "indoor environment", and generally separates or isolates indoor air from an external environment 26 of the dwelling 20 (also referred to as "outdoor" or "outdoor environment"). The term "dwelling" refers broadly to any enclosed structure in which one or more persons live, temporarily reside, seek shelter, work, store belongings, etc., such as a house (e.g., single family home, duplex, row house, cabin, etc.), an attached multi-unit housing (e.g., apartment, condominium, townhouse, etc.), a retail store, an office space or building, a warehouse, a building that houses one or more industrial or agricultural operations, and so on. In some specific embodiments, the dwellings of the present disclosure are in reference to residential homes and light commercial installations as those terms are commonly understood.

The HVAC system 22 operates to treat indoor air, and includes at least one temperature-control apparatus 36 that is configured to heat and/or cool flowing air that passes through apparatus 36 as motivated by a powered fan 32. In many embodiments, temperature-control apparatus 36 may comprise a heating unit (e.g. a furnace or firebox powered by natural gas, propane, LP, coal, or wood; or, an electric heater) and/or may comprise a cooling unit (e.g., an evaporator-coil unit of an air conditioner). HVAC system 22 comprises ductwork 30, which typically includes one or more supply ducts 31 that deliver air that has been temperature-controlled (e.g. heated or cooled) by apparatus 36, into interior 24 of dwelling 20 through one or more outlets 27. Ductwork 30 may also include one or more return ducts 33, which indoor (room) air may enter through one or more air-return inlets 29. Return air may then pass through return duct(s) 33 to be heated or cooled by apparatus 36. One or more thermostats 38 or similar controllers, located in interior 24 of dwelling 20, dictate operation of HVAC system 22, e.g. by activating fan 32 and/or temperature-control apparatus 36 in response to various conditions, such as an indoor air temperature that is sensed by the thermostat.

The movement of air through ductwork 30 is motivated by at least one powered fan 32. Often, the ductwork of multiroom dwellings may comprise multiple supply ducts and return ducts leading to and from different rooms of the dwelling, so that the rooms can be temperature-controlled. In many dwellings or individual rooms thereof, supply duct(s) 31 and/or return duct(s) 33 may be boxed in (e.g. by drywall or gypsum board) so that much or all of their length is inaccessible from interior 24 of dwelling 20. However, in some cases, a portion of interior 24 (e.g. a lowermost basement 21 that contains a machinery space) may contain ducting that is exposed. In some architectural styles (e.g. in loft-style apartments or in high-ceilinged restaurants) at least a portion of such ducting may be deliberately exposed, even in spaces that are commonly occupied. In any case, a supply duct 31 typically comprises at least one outlet 27 (that may be e.g. positioned in a designated through-aperture of a wall, floor or ceiling). Such an outlet 27 is often covered with a register or grill 80, as shown in exemplary embodiment in FIG. 2. Such registers are often made of e.g. metal, molded plastic, or the like, and may serve a decorative function and/or may comprise e.g. slats or visors so that airflow through the outlet can be increased or decreased.

It is customary for an HVAC system to include at least one air filter 34 as depicted in exemplary embodiment in FIG. 1. Such a filter 34 is often positioned on the air-return side of ductwork 30, e.g. upstream of fan 32 so that it can protect fan 32 and temperature-control apparatus 36 from particulate debris. Such an air filter can assume a variety of forms, and generally comprises filter media (e.g. electret filter media) configured to remove dust, debris and other particles (e.g., optionally fine particles having a diameter of 2.5 μm or less ("$PM_{2.5}$")) from the indoor air of the dwelling 20. Such a filter may often be disposable, recyclable, or cleanable. Over time, as captured particles accumulate in the filter media, the flow resistance of the media may increase and/or the ability of the media to capture additional particles may decrease. Thus, it is customary to replace such an air filter periodically.

The present disclosure provides systems and methods for predicting the replacement status of an air filter of an HVAC system. The term replacement status broadly encompasses e.g. a current or impending need for replacement, an estimate of the remaining usable filter life (regardless of how close the filter is to the end of its usable filter life), and so on. The systems and methods disclosed herein use one or more temperature sensors that can be easily added to an existing HVAC system or otherwise used in conjunction with an existing HVAC system; these systems and methods do not necessarily require the use of a temperature sensor that is pre-installed in the HVAC system e.g. when the HVAC system is installed in the dwelling.

The systems and methods disclosed herein rely on obtaining data correlated with the temperature of air outputted by the HVAC system. By outputted air is meant air that, after having been processed by a temperature-control apparatus 36, travels down a supply duct 31 and is emitted through an outlet 27 of the supply duct. By correlated with the temperature of outputted air means that the data is sufficiently associated with the actual temperature of the outputted air to allow the data to be used as a proxy for the actual temperature of the outputted air for the purposes disclosed herein. In a simple embodiment, this data can be the actual measured temperature of the outputted air. Other approaches are possible (for example, such data may be handled as raw data e.g. in the form of voltages from a temperature-sensing element without ever converting the data into actual temperatures), as discussed herein. The data is obtained as a function of time (whether continuously or intermittently), e.g. over weeks or months.

The systems and methods disclosed herein rely on the precept that air that is temperature-controlled (heated or cooled) by apparatus 36 and that is outputted by the HVAC system (e.g. through an outlet 27) will typically be at a different temperature from the temperature of the ambient indoor air in interior space 24 of the dwelling. By way of a representative example, an interior space of a residential dwelling may exhibit an indoor air temperature of e.g. 72° F. (e.g., corresponding at least generally to a set point of a thermostat used to control an HVAC system of the dwelling). When the HVAC system is operating in heating mode, the outputted air (measured e.g. at the point at which the air is emitted through an outlet 27 of a supply duct 31) may be at a temperature of e.g. 90, 100, 110, 120, or 130° F. or higher. So, an outputted air temperature of e.g. 90° F. or greater may indicate that the HVAC system is currently operating (in heating mode, in this particular example) and thus that filter 34 is actively filtering air. It is therefore possible to record the temperature of air that is outputted by the HVAC system over a given time interval, and to use this data to estimate the amount of time that the HVAC system was actively heating during this time interval. Similar considerations apply when an HVAC system is operated in cooling mode, in that a measured outputted air temperature of e.g. 65, 60, 55° F. or lower may indicate that the HVAC is currently operating in cooling mode.

As discussed in detail later herein, the obtained data may be used to determine a Total Runtime Value, by which is meant an estimate of the cumulative amount of time that the HVAC fan has been operating and thus that the filter has been actively filtering air. The Total Runtime Value can be compared to a Baseline Value of the filter in order to ascertain the filter replacement status. In a simple embodiment, a Baseline Value may be a nominal (expected) usable filter life (e.g. 300 hours), that is a fixed value supplied e.g. by a manufacturer of the filter. In some embodiments a Baseline Value may be adjusted based on particular conditions such as e.g. the presence of pets in the dwelling, as discussed in detail later herein. By way of a simple illustrative example, during an interval (e.g. of several months) since the installation of a filter, temperature-correlated data may provide a Total Runtime Value of 300 hours. If the Baseline Value of the filter in question is 300 hours, a user may be notified that the filter should be replaced. If the Baseline Value of the filter is 350 hours, the user may be notified that approximately 85% of the usable filter life has been expended. It will be appreciated that the systems and methods disclosed herein can serve to provide a user with an estimate of when an air filter should be replaced, without requiring arrangements such as, for example, measuring the actual flow resistance of the filter or predicting the filter replacement status based on e.g. weather data.

The arrangements disclosed herein rely on the use of at least one temperature sensor. By a temperature sensor is meant a device that includes at least one temperature-sensing element (e.g. a solid-state temperature-sensitive element such as a silicon-bandgap diode; a thermistor; a thermocouple, or the like) and that also includes associated circuitry as needed to operate the temperature-sensing element. In various embodiments, the circuitry of the temperature sensor may also be configured to do any or all of: recording data, processing data, transmitting data to a remote computing device, and reporting the filter replacement status to a user, all as discussed in detail later herein. Although the term "temperature sensor" is used for convenience, it is emphasized that in some embodiments it may not be necessary that the sensor (or a computing device that receives data from the sensor) calculates an actual temperature value of the outputted air. For example, the temperature-sensing element of the sensor may output a signal in the form of e.g. a voltage; the signal may be processed in that form, or in any form derived therefrom (e.g. it may be subjected to analog-digital conversion), without necessarily obtaining an actual temperature value. All that is necessary is that the data be correlated with the temperature of the outputted air so that the data allows the extraction of information as to whether the HVAC system is operating. All such variations are encompassed within the present disclosure.

In at least some embodiments, a temperature sensor as disclosed herein is an "add-on" sensor that is not provided (e.g. pre-installed) in the HVAC system at the time that the HVAC system is installed in a dwelling. In other words, a temperature sensor as used herein may be added to an existing HVAC system. The temperature sensor is positioned and arranged so that it can obtain data correlated with the temperature of air outputted by the HVAC system as a function of time. Ideally, the temperature sensor will be installed in a location that is easy to access. In some embodiments, the temperature sensor is installed proximate to an outlet 27 of a supply duct 31 of the HVAC system. By proximate to an outlet is meant that the sensor is positioned inside the duct no more than 60 cm upstream from the outlet (it being evident that a greater distance than this would make it difficult for a person to reach such a location). By proximate to an outlet is further meant that the sensor is positioned no more than 10 cm downstream from the outlet (it being evident that if the sensor is positioned e.g. farther out into a room, the sensor might not be able to measure the temperature of air emitted from the outlet with sufficient fidelity).

Figure 2:
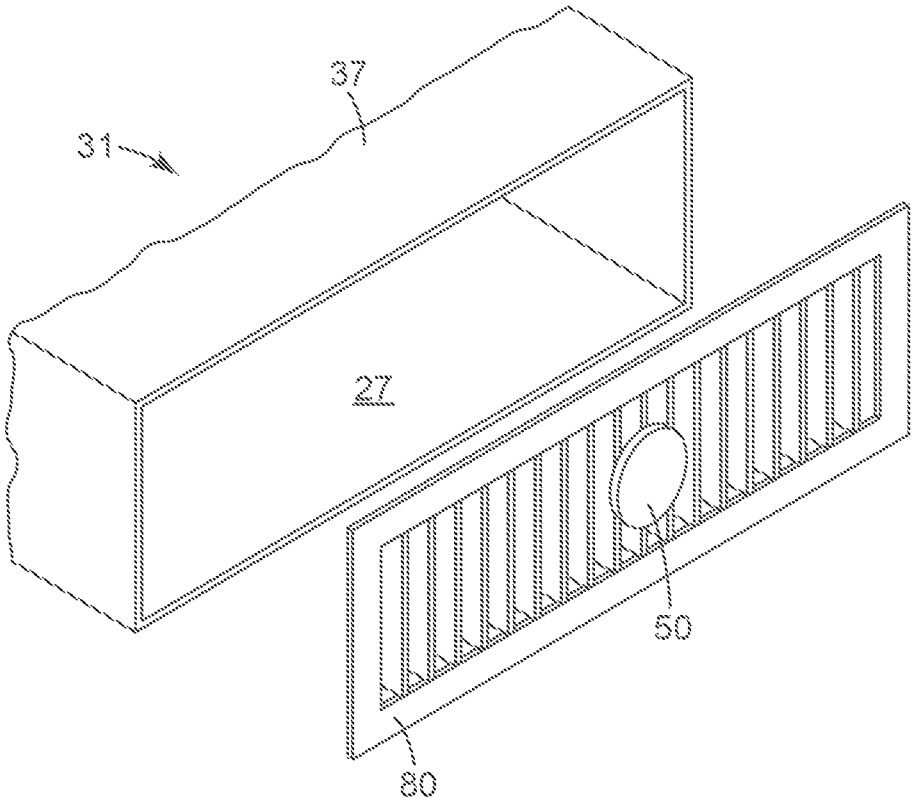
FIG. 2 is a perspective, partially exploded view of an exemplary outlet of an HVAC system, with an exemplary temperature sensor positioned proximate the outlet.

In a particularly convenient embodiment, a temperature sensor 50 may be mounted on a register (grille) 80 that is present at an outlet 27 of an HVAC supply duct 31, as shown in exemplary embodiment in FIG. 2. Such arrangements can allow the sensor to be positioned in the stream of temperature-controlled air that is emitted from the duct, to facilitate the measurements disclosed herein. In some embodiments, temperature sensor 50 may be configured to sense the temperature of the flowing air, while being relatively thermally isolated from register 80 itself. For example, temperature sensor 50 may comprise one or more barriers (e.g. infrared-reflective walls) that are at least partially interposed between register 80 and a temperature-sensing element of the temperature sensor. For example, temperature sensor 50 may be designed so that air may need to travel along a serpentine path through a portion of sensor 50 to reach the temperature-sensing element. Such arrangements may reduce any tendency of the temperature-sensing element of the temperature sensor to be heated by infrared radiation from the register. In some embodiments a low-thermal conductivity fastener may be used to mount the temperature sensor on the register. An adhesive comprising at least one layer of foam (e.g. a foam tape comprising a pressure-sensitive adhesive) may be useful for such purposes. In a particularly convenient embodiment, the temperature sensor may be mounted on a register using a stretch-releasable adhesive available from 3M Company, St. Paul, Minn., under the trade designation COMMAND. In some embodiments the temperature sensor may be mounted on a register by a mounting device that includes a base portion that is attached (e.g. snapped, clipped, screwed, and so on) to the register, and that also includes an extender portion (e.g. a molded plastic arm) that positions the temperature sensor a suitable distance outward (downstream) from the register. Any such arrangement may minimize conduction of thermal energy from the register to the temperature sensor.

Configuring a temperature sensor to minimize the thermal energy that is received by the temperature sensor from the register by infrared radiation and/or by conduction, can provide that the temperature sensor is rapidly responsive to the actual temperature of air to which the sensor is exposed. However, this may not be necessary in all embodiments. Rather, in some embodiments a temperature sensor may, to at least some extent, measure a temperature of the register itself rather than only measuring the temperature of air. For example, a temperature sensor may be mounted directly to a surface (e.g. an outside surface) of the register, so as to measure the temperature of the register. Such arrangements can still achieve the objective disclosed herein, since the register itself will be heated or cooled according to the temperature of the air that flows through the register. Thus, the register temperature may be used as suitable proxy for the actual temperature of the outputted air. One consideration that may arise in such embodiments is that a register (which may be made of e.g. metal or plastic) may have a higher thermal inertia than the air itself, with the result that the temperature of the register (and hence the temperature reported by the temperature sensor) may lag behind the actual air temperature. If desired, provisions may be made to ensure that this does not impact the ability of the disclosed systems and methods to acceptably predict the filter replacement status, as discussed in detail later herein.

As discussed above, in some embodiments it may be convenient to position a temperature sensor 50 proximate to a register 80 of an outlet 27 to measure the temperature of the outputted air emitted from the outlet and/or to measure the temperature of the register. However, in some embodiments temperature sensor 50 may be a non-contact temperature sensor which can measure the temperature of register 80 from a non-local location (e.g., a location at least 2, 5, 10, or 20 cm away from the register). In particular embodiments, temperature sensor 50 may be an infrared temperature sensor that can interrogate the temperature of a surface (such as a surface of a register 80) without contacting the surface. Thus in some embodiments, a temperature sensor 50 as disclosed herein may be mounted a suitable distance from a register 80 without being in contact with any portion of the register.

In some embodiments it may not be necessary to measure the temperature of a register of an outlet of a supply duct, or to measure the temperature of the outputted air itself, in order to achieve the objects disclosed herein. Rather, it may be possible to measure the temperature of an outer surface of a supply duct 31 at any suitable location, which need not necessarily be in close proximity to an outlet of the duct. This can be achieved as long as a portion of the supply duct can be easily accessed. For example, supply ducts are often exposed e.g. in unfinished basements, closets, or attics of residential houses. In such a case, a temperature sensor may be attached to an outer surface of an exposed supply duct 31 at a location 35, as indicated in generic representation in FIG. 1. Alternatively, a non-contact temperature sensor (e.g. an infrared temperature sensor) may be non-locally positioned to interrogate the temperature of the outside surface of the supply duct. For such arrangements to be achieved, all that is needed is that at least at one location, the supply duct is exposed (e.g., it is not boxed in by sheetrock); and, that the outer surface of the duct is not so heavily insulated as to prevent adequate temperature measurements from being obtained. It will be appreciated that in some embodiments (e.g. when a temperature sensor is attached to an outside surface of a supply duct, or is attached to a surface of an outlet register with the intention of measuring the temperature of the register), it may be advantageous to mount the temperature sensor to the surface to be monitored with a high thermal-conductivity fastener. In some embodiments a temperature sensor may be mounted to a surface (e.g. of a metal supply duct or outlet register) by use of one or more magnets.

From the above discussions it will be appreciated that obtaining data correlated with the temperature of air outputted by the HVAC system may be performed in any suitable manner, whether it involves direct measurement of the air temperature, measurement of the temperature of a register of an outlet through which the air is emitted, or measurement of the temperature of an outside (or inside) surface of a supply duct through which the air flows.

In various embodiments, temperature sensor 50 may obtain data (measurements of temperature or a temperature-correlated parameter) continuously, or at desired intervals. In some embodiments, the temperature sensor may obtain data intermittently according to a time clock. In particular embodiments of this type the temperature sensor may comprise a "sleep" mode that functions only to operate the time clock and perform other ancillary functions as needed. As scheduled by the time clock, the temperature sensor may awaken intermittently to an "interrogation" mode in order to obtain data. The temperature sensor may also awaken out of the sleep mode in order to transmit data, process data, and so on, according to a schedule set by the time clock, a signal received from a remote computing device, and/or according to input from a user. Such arrangements can optimally preserve the life of a battery (e.g. a button-cell battery) that powers the temperature sensor. Data should be obtained at a high enough frequency to ensure that adequate tracking of duty cycles (on/off cycles of the heater or cooler) of the HVAC system is achieved. Accordingly, in various embodiments, the temperature sensor may awaken to an interrogation mode and obtain temperature-correlated data, at a frequency of no less than once every 60, 30, 20, 15, 10, 5, 2, or 1 minute(s). In further embodiments, the temperature sensor may awaken to an interrogation mode and acquire data at least once every 2, 5, 10, 20, 30 seconds, or 1, 2, or 3 minutes.

In some embodiments, the temperature sensor 50 may do more than obtain data and transmit the data elsewhere for processing. Rather, in some embodiments the temperature sensor may use the obtained data to determine a Total Runtime Value of the fan of the HVAC system. In some embodiments the temperature sensor may estimate a replacement status of the air filter as a function of a comparison of the Total Runtime Value with a Baseline Value. Thus in some embodiments the temperature sensor may comprise a processing module to perform such functions. In some embodiments the temperature sensor may report a replacement status of the air filter, and may comprise a reporting module to perform such functions. In such embodiments the temperature sensor may be a stand-alone unit that does not need to interact with a remote computing device in order to obtain, and report, the replacement status of an air filter. In other embodiments in which the temperature sensor is arranged to communicate with a remote computing device, the temperature sensor may comprise a communication module for such purposes. In such cases the remote computing device may comprise any or all of a processing module, a reporting module, and a communication module.

The temperature-correlated data as obtained by the temperature sensor is processed by a processing module. As noted above, in some embodiments such a processing module may be resident on the temperature sensor itself. In other embodiments, such a processing module may be resident on a remote computing device 300, as depicted in exemplary embodiment in FIG. 3. In such embodiments, the temperature-correlated data will be transmitted by a communication module of temperature sensor 50 to the computing device, which will include a complementary communication module capable of receiving communications from temperature sensor 50. In some embodiments, a portion of the processing may be done on-board temperature sensor 50, with the partially processed data being transmitted to a computing device for the remainder of the processing. In some embodiments the data may be transmitted from a computing device to another computing device (e.g. a cloud server or the like) for processing.

Thus in general terms, a processing module can be resident on the temperature sensor itself, on a mobile device (e.g., mobile smart phone, tablet computer, personal digital assistant (PDA), laptop computer, smart speaker, smart TV, intelligent personal assistant, media player, etc.) or a non-mobile device (desktop computer, computer network server, cloud server, etc.). Such a processing module may rely on one or more processors configured to operate according to executable instructions (i.e., program code), in combination with memory and any other circuitry and ancillary components as needed for functioning. The memory can be of a conventional format, such as one or more of random-access memory (RAM), static random-access memory (SRAM), read only memory (ROM), erasable programmable read-only memory (EPROM), flash drive, hard drive, etc. In some embodiments the processing module will reside in an application ("app") of a mobile device. Regardless of how the processing module is arranged and on what kind of device it resides, it serves to predict a replacement status of the air filter 34 installed in the HVAC system 22, as a function of runtime of the fan 32.

A replacement status of an air filter as predicted by a processing module as described above, is reported to a user of the HVAC system, such as an occupant of the dwelling served by the HVAC system. This is done by a reporting module, which may be resident e.g. on the temperature sensor itself, or on a remote computing device such as a mobile device (e.g. smartphone) or the like. The term "replacement status" relates to the remaining usable life of the air filter 34. For example, the reporting module may report that the air filter has expended approximately 100% of its usable life and should be replaced. Whether or not the air filter needs replacing at the time of reporting, the module may report the usable lifetime that has been used or that is remaining. For example, in the exemplary embodiment of FIG. 3, mobile device 300 provides a visual indication that approximately 95% of the usable lifetime of the filter has been used, thus the filter should be replaced soon.

An exemplary method of predicting a replacement status of a filter and reporting status information to a user will now be presented. It will be understood that this is provided as a representative example and that many variations are possible. A temperature sensor is mounted e.g. on an outlet register or is otherwise positioned to collect data correlated with the temperature of air outputted by the HVAC system. The temperature sensor may be configured to maintain a low-power (sleep) state and to periodically awaken from this state in order to collect data, which can be stored in memory on-board the sensor, or may be transmitted to a remote computing device for storage. Upon the installation of an air filter in the HVAC system, the temperature sensor is instructed to obtain data, which may continue for any desired time period. At the end of the desired time period (or as triggered by a query from a user), the accumulated data is processed to determine the Total (cumulative) Runtime Value for the time period. This Total Runtime Value is indicative of a total length of time the HVAC fan has operated and is thus indicative of the length of time that the particular filter has been filtering air. The Total Runtime Value can be expressed as a length of time (e.g., estimated actual runtime of the fan 32 in terms of minutes, hours, days, etc.). In other embodiments, the Total Runtime Value can represent a variable other than length of time, but that is correlated with the length of time, to a sufficient extent to allow the method to be performed. The Total Runtime Value is then compared to a Baseline Value in order to determine whether the air filter is approaching the end of its usable life. This may be reported to a user (as noted elsewhere herein, the status of the filter may be reported even if the filter has not yet approached the end of its usable life). As discussed later herein in further detail, the Total Runtime Value at a given point in time can be saved in memory. Data can then be taken for an additional time period and saved as a Current Runtime, which can then be added to the previous Total Runtime Value to provide an updated Total Runtime Value, which can again be compared to the Baseline Value. This process of accumulating data, periodically processing the data to determine the air filter status, and periodically reporting the filter status to a user, can go on as long as desired. Upon replacement of the filter with a new filter, the user can provide input to the processing module for the process to start again with an initial Total Runtime Value of zero.

The processing of temperature data can be performed in any manner that provides an estimate of the Total Runtime Value that is sufficiently representative of the actual runtime of the HVAC fan. The processing may be tailored to the particular HVAC system in use. In one simple embodiment as mentioned earlier herein, any temperature measurement that is above a certain threshold (e.g. 90° F.) may be taken as an indication that the HVAC system is operating (in heating mode, in this example). The threshold temperature may be chosen based on the characteristics of the HVAC system (e.g., the temperature to which the air is heated, the distance from the heater to a location (e.g. an outlet) at which the air temperature is measured, the setpoint of the HVAC thermostat, etc.). The threshold temperature may be pre-loaded into the processing module or may be choosable by a user through a data-entry interface. Similar arrangements may be made for operating an HVAC system in a cooling mode, choosing a certain temperature threshold (e.g. 60° F.); so that any reading below that value indicates that the HVAC system is operating (in cooling mode).

In some embodiments, it may be advantageous to modify the above method. This is illustrated with reference to FIG. 4, which presents actual data taken by a prototype temperature sensor mounted on a supply register of a residential HVAC system. This data, which is taken with the HVAC in cooling mode, reveals several stages or conditions. In one such stage (211), the measured temperature is dropping rapidly, indicative that cold air is passing through the register. That is, the HVAC system is actively cooling the air. In a subsequent stage (212), the measured temperature is climbing rather rapidly, indicating that the HVAC system has stopped operating (i.e. the fan has stopped blowing air) so that the temperature of the temperature sensor is climbing back toward the ambient temperature of the indoor air in the room. (The fact that the reported temperature does not completely return to the indoor air temperature within a few minutes indicates that in this particular experimental setup, the temperature sensor may have been in thermal communication with a register (e.g., a metal register) that exhibited a relatively large thermal inertia.) After this, another stage (213) is entered in which a gradual temperature decrease occurs; in this case corresponding to diurnal cooling of the dwelling during the overnight hours. After this, another stage (214) is entered which corresponds to diurnal heating of the dwelling during daytime hours. (During these stages the HVAC system is not operative so the temperature sensor is essentially tracking the ambient indoor air temperature.) At approximately mid-afternoon, either the ambient indoor air temperature rises above the setpoint of the HVAC thermostat, and/or the setpoint, after having been held at a relatively high temperature during the daytime, is lowered to a temperature desired for the evening hours; this causes the HVAC system to begin operating in cooling mode thus entering another cooling stage (211'). (Relatively similar behavior may be expected for an HVAC system operating in heating mode, except that the temperature changes may occur in roughly the opposite directions excepting diurnal effects.)

Figure 4:
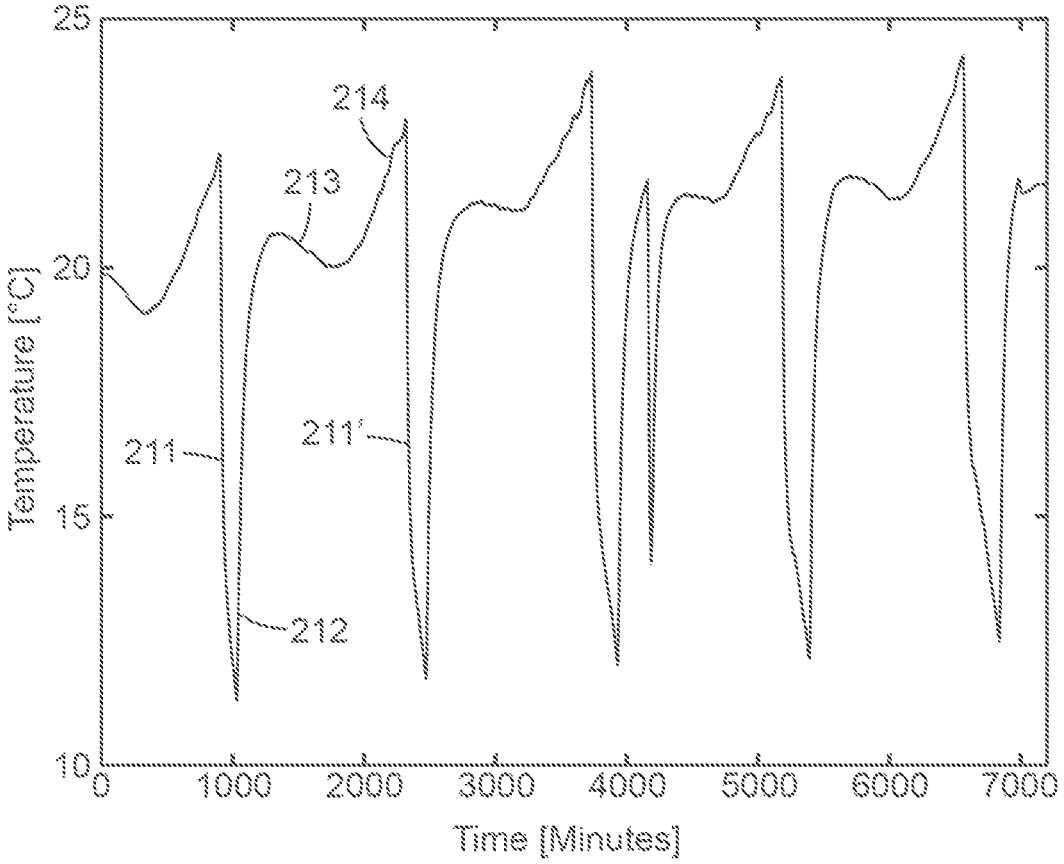
FIG. 4 presents experimental data obtained from a temperature sensor mounted proximate an outlet of an HVAC system.
Figure 5:
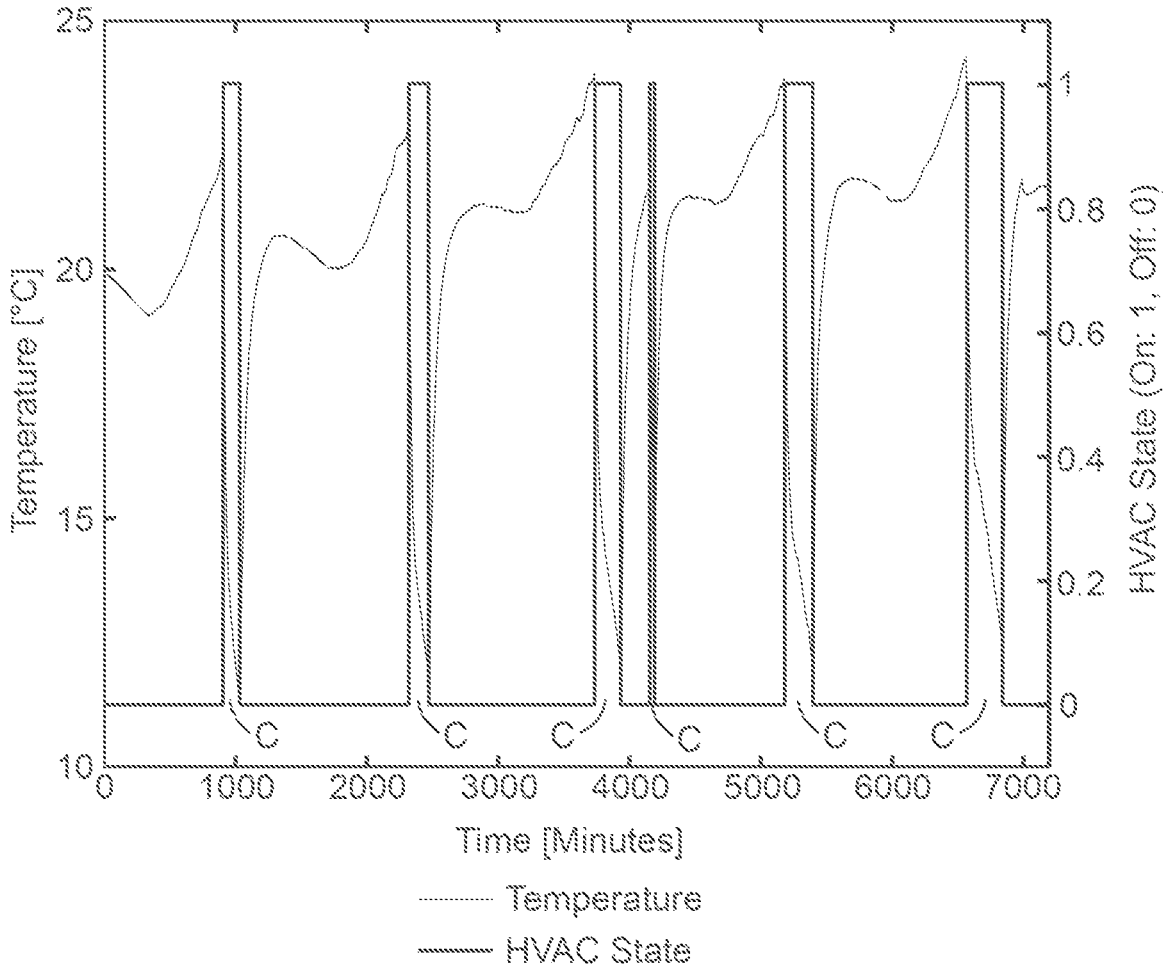
FIG. 5 depicts estimated time intervals of actual operation of the HVAC system, obtained from the temperature data of FIG. 4.

Based on the above observations it can be estimated that the HVAC is operating (in cooling mode) at the times shown in FIG. 5, which presents the temperature data of FIG. 4 with the estimated operational times (labeled "C") of the HVAC system superimposed thereon. In the exemplary data of FIG. 5, the Total Runtime Value (unadjusted) is estimated to be 994 minutes (16.6 hours); this Total Runtime Value could then be compared to an appropriate Baseline Value for the air filter in use, to obtain a determination of replacement status of the filter.

It will be noted that the above is an example of a general category of embodiments in which the process of obtaining a Total Runtime Value takes into account (e.g. calculates) a slope of the time-temperature curve rather than relying only on the value of the temperature. In other words, whether or not the actual temperature as measured by the temperature sensor is below a given temperature (in the case of cooling mode), a sufficiently large, negative value of the slope of the time-temperature curve (as in stages 211 and 211' of FIG. 4) can be taken as an indication that the HVAC system is operating (in cooling mode). Conversely, whether or not the actual temperature as measured is above a given temperature, a positive of the slope (as in stage 212) or even a slope with a value that is negative but is relatively small (as in stage 213) can be taken as an indication that the HVAC system is not operating. (Similar behavior, but operating in the opposite direction, may arise when the HVAC system is operating in heating mode.)

Thus in some embodiments, the slope of the time-temperature curve may be taken into account (either alone, or in combination with the absolute temperature) in arriving at the Total Runtime Value. For example, a time-temperature slope that exceeds a threshold positive value may be indicative that the HVAC system is operating in heating mode; similarly, a time-temperature slope that exhibits a negative slope that exceeds a threshold value may be indicative that the HVAC system is operating in cooling model. In some embodiments, the previously mentioned time clock can serve an additional function beyond simply acting as a timer to keep track of when to obtain data and/or to transmit data. Thus in some embodiments, the time clock can keep track of the actual day and clock time so that diurnal variations in the temperature of the house can be taken into account. For example, a slow temperature drop during the overnight hours may be interpreted as nocturnal cooling as part of a diurnal cycle rather than signifying that the HVAC is operating in cooling mode.

Still further, a determination of whether a particular slope (and/or an temperature) does correspond to an HVAC system being active, need not be interpreted strictly according to the local value of the slope (or of the temperature), taken alone. Rather, in some embodiments a data set spanning an extended time period (e.g. of several days or more) can be considered in order that trends may be observed that provide further indications of stages that correspond to active heating or cooling. Thus in some embodiments, the processing module may be configured to examine an entire data set before assigning indications of HVAC operational status to various time intervals within the data set. In general, of course, the temperature data can be smoothed, filtered, or otherwise processed to enhance the accuracy of the prediction of filter status. In particular embodiments, the data may be differentiated, integrated, transformed, or otherwise subjected to any suitable mathematical manipulation, for such purposes.

It will be appreciated that methods that use the temperatures of the time-temperature data set may be particularly well suited for an HVAC system that exhibits long duty cycles (e.g. extended periods of continuous operation separated by extended continuous periods of inactivity); such methods may also be well suited for use with a temperature sensor that is configured and positioned to exhibit very little time lag. Methods that use the slope of the time-temperature data set may be particularly well suited for an HVAC system that exhibits short duty cycles (e.g. that cycle on and off over relatively short periods of e.g. a few minutes); such methods may also be well suited for use with a temperature sensor that, as positioned and configured, exhibits at least some time lag (e.g., a sensor that reports the temperature of a metal register subject to considerable thermal inertia). However, either approach, or any combination thereof, may be used as desired with any HVAC system, as long as the validity of the predicted filter replacement status is acceptable.

In still further embodiments, the processing module may be configured to accept input data (e.g. entered through a data entry interface by a user) that includes the set point of a thermostat that controls the HVAC system. The previously-mentioned threshold temperatures can then be chosen by the processing module in view of this inputted set point. This may be particularly helpful in use with HVAC systems that serve dwellings (e.g. engine rooms, greenhouses, rooms containing server farms, and so on) that have temperature setpoints that differ appreciably from conventional "room temperatures" of e.g. 65-75° F. In some embodiments the processing module may be configured to accept input data that includes an HVAC set point (as established e.g. by a programmable thermostat) that varies as a function of the time of day (and as a function of weekdays and weekends, in some cases). The previously-mentioned threshold temperatures can thus be chosen by the processing module, as a function of the time of day and/or of the day of the week.

In particular embodiments, the processing module may accept HVAC set point data in the circumstance that a homeowner is to be gone for an extended period of time. The processing module may thus be able to take into account when a thermostat set point has been changed significantly during a homeowner's absence. Still further, the processing module may be able to serve a diagnostic function regarding the state of the HVAC system. For example, the processing module might send a notification if the HVAC system appears to have not run for an extended period of time; or, in general, if the HVAC seems to be exhibiting very long or short duty (running) cycles. A homeowner could thus be notified that a service call may be indicated.

The processing module thus may spend some time in a learning mode in which it recognizes patterns in the behavior of the measured temperatures, for example in which it associates observed temperature values and/or time-temperature slopes with e.g. diurnal cycles and/or with periodic changes in the set point of the HVAC thermostat. If desired, during such a learning mode a user may input status information as to the operational state of the HVAC system at one or more times, into the processing module. This may allow the processing module to more closely correlate the operating/non-operating condition of the HVAC system with the observed temperature values and/or time-temperature slopes. Once this has been accomplished, the processing module may be more able to correlate observed time-temperature behavior with the operational status of the HVAC system, even if, e.g., the thermostat set point temperatures and/or timing are changed. The processing module may be switched from such a learning mode into a standard operating mode, at any suitable time.

Many variations on the above approaches are possible. For example, a first temperature sensor, configured and positioned as discussed above to monitor the temperature of the air outputted by the HVAC system, may be used in combination with a second temperature sensor that is positioned far from any outlet of the HVAC system and is thus configured to report the temperature of the ambient indoor air. The second temperature sensor might be a standalone sensor, e.g. of a similar design and construction as the first temperature sensor. Or, the second temperature sensor may be resident on a smartphone (whether e.g. supplied in the smartphone as manufactured, or as an add-on device or module that can be coupled to the smartphone when it is desired to obtain a temperature measurement). The processing module may rely on input from both sensors, which may allow the temperature of the outputted air to be directly compared with the ambient air temperature at any given time, to enhance the ability of the processing module to determine whether the HVAC system is currently operating. Still further, in some embodiments the temperature sensor may be configured (e.g. as instructed by the processing module) to obtain data at a fairly high frequency (e.g. every few minutes) for an initial period. As time passes, e.g. with the HVAC system continuing to exhibit predictable behavior, the processing module may instruct the temperature sensor to reduce this frequency, in order to conserve the battery life of the temperature sensor. If the data appears to exhibit significant deviations from recent trends (e.g. upon a changeover from heating to cooling season), the processing module may instruct the temperature sensor to obtain data at a higher frequency, at least for a time.

In many embodiments, a Total Runtime Value obtained by the arrangements disclosed above, may be used as is. For example, this may be conveniently done for many demand-operation HVAC units in which the fan only operates when the unit is actively heating or cooling. However, the arrangements disclosed herein may also be used in HVAC units (e.g., certain high-efficiency units) that have a circulation mode in which the fan runs, e.g. at a lower speed, during at least a portion of the time that the HVAC unit is not actively heating or cooling. Such an occurrence may be compensated for by adding an Adjustment that takes this into account, so that the Total Runtime Value is an Adjusted Total Runtime Value.

In such embodiments, the processing module may, for example, receive input regarding the percentage of non-heating and non-cooling time that the fan runs, and regarding the speed at which the fan runs during such times (expressed e.g. as a percentage of the fan speed during heating and cooling operations). By way of specific example, a particular HVAC system may comprise a fan that runs at 20% speed at all times when the unit is not heating or cooling. If a Total Runtime based on the above methods was, for example, 300 hours over a 30 day (720 hour) period, the fan would have run for the remaining 420 hours in circulation mode at 20% fan speed. In such a case, the Adjusted Total Runtime Value would be 300+(420×0.20), or 384 hours. Parameters regarding a circulation mode (e.g.

percentage of time the fan runs, and fan speed) can be entered into the processing module via a user interface, in similar manner as described elsewhere herein for entering various parameters. Similarly, if the HVAC system is configured so that the fan operates at a different speed when cooling than when heating, this information can be entered into the processing module so that the Total Runtime Value may be adjusted accordingly. While these and other parameters (e.g. an estimate of pollen conditions, household dust, the presence of pets, and so on) may be entered e.g. into a processing module resident on the temperature sensor, in many embodiments it may be advantageous that the processing module be located on a remote computing device (e.g. a smartphone) so that such parameters can be easily entered e.g. through a smartphone "app".

As discussed herein, a replacement status of an air filter is estimated as a function of at least the Total Runtime Value (which may be an Adjusted Total Runtime Value). In some embodiments, the estimation may be based upon (e.g. based solely upon) a comparison of the Total Runtime Value to a Baseline Value. The Baseline Value is indicative of a usable lifetime of the air filter, and represents an estimate of the length of time the filter can be exposed to forced airflow while continuing to perform at a desired level. The Baseline Value can be expressed in the same units as the Total Runtime Value (e.g., hours, minutes, unitless, etc.), and can be pre-determined, ascertained, or derived, in various ways as described below.

In some embodiments, the Baseline Value can be, or can be based upon, a pre-determined number or value that is stored by the processing module. In some embodiments, the pre-determined value can be based upon the conventional three month replacement interval recommended for most residential HVAC air filters. For example, the value can be e.g. a number of hours (e.g. 300, 400 or 500) that corresponds, on average to a number of hours that an HVAC is expected to operated over a three month period. The predetermined value may be chosen in view of the particular characteristics of the filter in use. Such a value may be entered into the processing module e.g. via an application resident on remote computing device (e.g. a smartphone). Or, it may be read e.g. from a barcode or QR code provided on the filter, e.g. by a smartphone that is equipped with an optical reader; or, it may be read e.g. from an RFID tag provided on the filter, e.g. by a smartphone that is equipped with an RFID reader.

In some embodiments, the Baseline Value can be an Adjusted Baseline Value that is adjusted in accordance with information relative to one or more other parameters relevant, for example, to the HVAC system, to the dwelling serviced by the HVAC system, and/or to the user's preferences. Such a parameter may, for example, relate to a likelihood that the particular air filter may be exposed or subjected to elevated pollution levels. Information relating to one or more such parameters may be inputted to the processing module (e.g. by a user) a single time and stored in memory for use with all subsequent filter prediction operations. Alternatively, such information may be inputted each time a new air filter is installed; or, it may be periodically updated during the lifetime of that air filter (e.g. with the Baseline Value being adjusted accordingly).

In various embodiments the Baseline Value can be adjusted in accordance with one or more pollution-related parameters, in order to enhance the prediction of the usable lifetime of the air filter. Exemplary pollution-related parameters include, but are not limited to: dust levels in the outdoor environment of the dwelling; ground ozone levels at the outdoor environment of the dwelling; fine particle levels ($PM_{2.5}$) in the outdoor environment of the dwelling; pollen count levels in the outdoor environment of the dwelling; the presence and number of pets in the indoor environment of the dwelling; the number of people normally within the indoor environment of the dwelling; window opening habits or preferences of the user; and, the presence of smoke in the indoor environment of the building due to e.g. the burning of tobacco products, incense or candles. Other such parameters will be readily apparent.

Alternatively or in addition to the above parameters, the Baseline Value can be adjusted in accordance with one or more HVAC-related parameters, in order to enhance the prediction of the usable lifetime of the air filter. Exemplary HVAC-related parameters include, but are not limited to: the model or type of the air filter; the dust-holding capacity of the air filter; the filter change interval recommended by the manufacturer of the air filter; the filter change interval recommended by the manufacturer of the furnace or air conditioning unit of the HVAC system; the efficiency of the HVAC system (e.g., cooling efficiency, heating efficiency, or both); the capacity of the HVAC system (e.g., cooling capacity, heating capacity, or both); the frequency at which the HVAC system is serviced; and the initial pressure drop across the air filter. Other such parameters will be readily apparent.

Alternatively or in addition to the above parameters, the Baseline Value can be adjusted in accordance with one or more user preference-related parameters, in order to enhance the prediction of the usable lifetime of the air filter. Exemplary user preference-related parameters include, but are not limited to the user expectation for air quality of the indoor environment of the dwelling based e.g. on personal preferences or on medical conditions (e.g. allergies or chronic obstructive pulmonary disease); and, the user preference for fan operation. For example, a user may prefer to run the HVAC fan continuously or nearly continuously e.g. in order to maintain a more even temperature within the dwelling regardless of whether the HVAC is actively heating or cooling; or, in order to provide white noise to mask background noises. Other such parameters will be readily apparent.

Regardless of how the Baseline Value is adjusted (or not), the comparison of the Total Runtime Value with the Baseline Value can serve as the basis for characterizing a replacement status of the air filter. For example, where the Total Runtime Value is found to approximate, equal, or exceed the Baseline Value, the processing module can be configured to report to a user that the air filter should be replaced or is nearing the time for replacement. It will be obvious that the Total Runtime Value need not exactly equal the Baseline Value in making such a determination. For example, where the Total Runtime Value is within a predetermined percentage of the Baseline Value (e.g., within 10%), the replacement status can be reported in terms of the air filter nearing the end of its usable lifetime.

Under circumstances where, for example, the determined replacement status does not suggest immediately replacing the air filter, the processing module may store the accumulated information and can repeat the actions of obtaining data and processing the data. In a simple example, upon a new filter being installed in the HVAC system, temperature-correlated data may be obtained (e.g. every five minutes) and stored for one week, at the end of which the Total Runtime Value is calculated. This information is stored as a Current Runtime. Data is then obtained for a second week, at the end of which a new Current Runtime is calculated for that second week and is added to the previous Total Runtime Value to get an updated Total Runtime Value. Each Total Runtime Value, as updated, is compared to the Baseline Value, with the process continuing until an updated Total Runtime Value is reached that is sufficiently close to the Baseline Value that a reporting that the usable filter lifetime is nearing its end, is triggered. Of course, if desired information regarding the filter status may be reported e.g. at the end of each Current Runtime, even if the filter is nowhere near the end of its usable filter lifetime. This may ensure that the user is given advance notice to have a replacement filter at the ready when the time does come to replace the filter.

In some embodiments, the filter prediction operation for a particular air filter is terminated once the replacement status indicates that the air filter should be replaced. A report is optionally delivered to the user as described below, and it is assumed that the air filter is replaced. In some embodiments, the filter prediction operation is then re-initiated (e.g., automatically or in response to a user prompt) for predicting replacement status of the newly-installed air filter. Alternatively, the processing module can be configured to re-initiate the filter prediction operation only in response input from the user confirming that a new air filter has been installed. In other words, unless prompted by the user, the processing module may continue to estimate the Total Runtime Value and replacement status for the not-yet-replaced air filter, optionally providing the user with information indicative of the extent to which the air filter is beyond its usable lifetime.

It is noted that a user may, if desired, choose to continue using an air filter even after the end of its "usable lifetime" (conversely, a user may, if desired, choose to replace an air filter before it has reached the end of its "usable lifetime"). The terminology of a "usable lifetime" does not imply that an air filter cannot perform at least some beneficial filtration after the "usable lifetime" is reached, nor does it imply that the air filter must be necessarily replaced immediately upon a report that the end of the usable lifetime has been reached.

In at least some embodiments, the systems and methods of the present disclosure include reporting the filter replacement status to a user. This can be done by a reporting module, which may be resident on the temperature sensor itself or may be resident on a remote computing device. In some embodiments, both the sensor and a remote computing device may be able to provide such a report, e.g. with the choice being available to the user. The report may take any suitable form. In simple examples, a reporting module of a temperature sensor may include e.g. a visual reporter such as a light that illuminates, and/or an auditory reporter such as a beeper. If desired, the temperature sensor may comprise a display screen of sufficient size that an alphanumeric text string (e.g. "95% filter life reached") and/or one or more symbols or icons can be displayed rather than merely an illuminated light. In some embodiments, the reporting module may be resident on a remote computing device, e.g. a smartphone, tablet computer, laptop computer, desktop computer, and so on. In various embodiments, the reporting module may be configured to report the filter status by sending a communication (which may be a text string, and/or may include any suitable graphical symbols or representation) in the form of an email, a text message, and so on, to any device selected by the user.

In many embodiments, a report of filter replacement status may be provided to a user as a "push" notification that is triggered automatically by the processing module without requiring any action by the user. However, if desired, the processing module can be configured so that information can be provided to the user on demand, e.g. in response to a status inquiry that is input by the user. This functionality may be in addition to, or in place of, a "push" reporting functionality.

Figure 3:
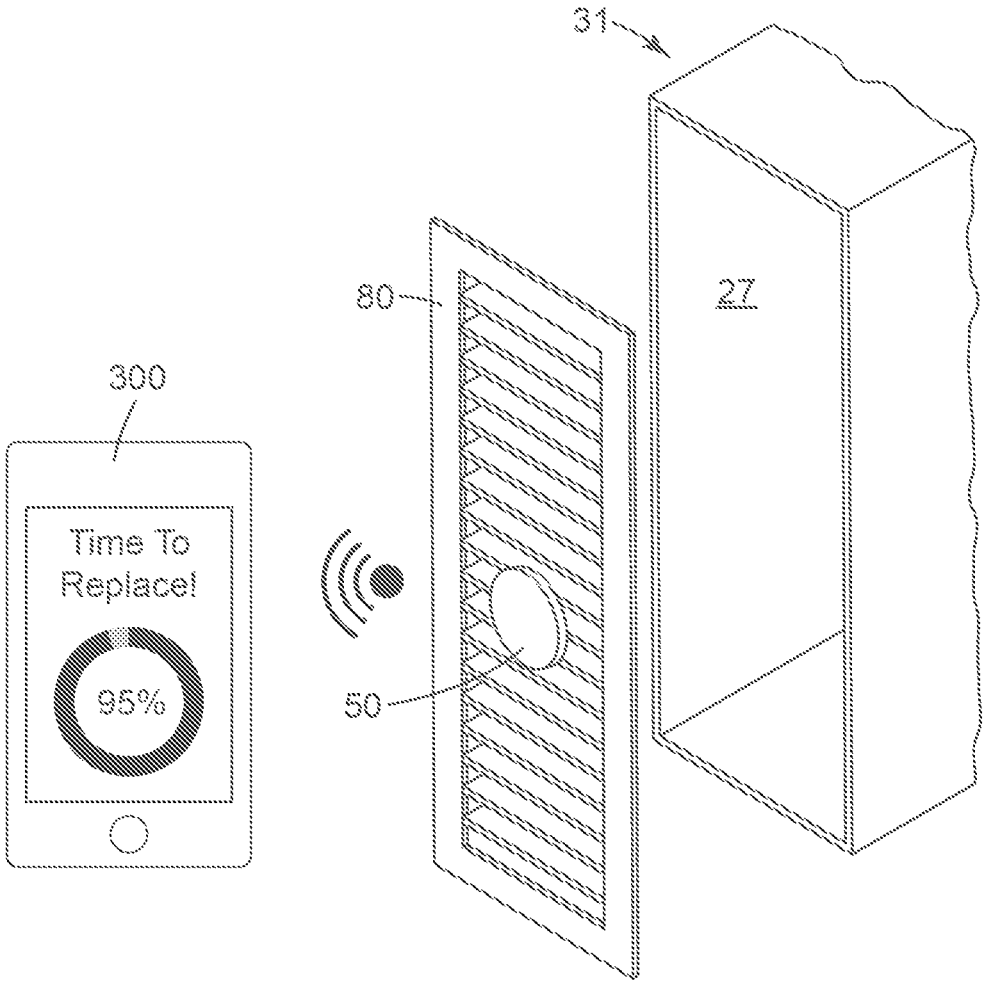
FIG. 3 is a perspective, partially exploded view of an exemplary temperature sensor mounted on a register of an HVAC outlet and configured to communicate with a remote computing device.

In many embodiments, it may be convenient for the temperature sensor to obtain temperature-correlated data, to store the data on-board the temperature sensor, and to transmit the data to a remote computing device (e.g. to a mobile device 300 as shown in FIG. 3) at a suitable time. In some embodiments this may be done e.g. on a pre-arranged schedule (e.g. weekly), using e.g. any of the communication methods mentioned below. In some embodiments this may be done on occasions when the remote computing device is brought sufficiently close to the temperature sensor, using e.g. near-field (contactless) communication of any of the types commonly used in proximity-communication cards, contactless smart cards and devices, and the like.

To facilitate any such communication, the temperature sensor may comprise a communication module, and the remote computing device may similarly comprise a complementary communication module, as necessary for the particular communication method chosen. In some embodiments, a communication module of the temperature sensor may be configured to only transmit (e.g. to a remote computing device). In other embodiments, a communication module of the temperature sensor may be configured to also receive, e.g. in embodiments in which a remote computing device sends the temperature sensor instructions to transmit data to the remote computing device, or instructions as to the frequency at which data is to be obtained. In the event that a remote computing device attempts to communicate with a temperature sensor and receives no response, a processing module of the remote computing device may provide a notification to a user, e.g. to check whether a battery of the temperature sensor has expired or whether the temperature sensor has been damaged.

The communication may be chosen from any wired or wireless short-range and long-range communication interfaces. A short-range communication interfaces may be, for example, local area network (LAN), interfaces conforming to a known communication standard, such as Bluetooth standard, a Bluetooth Low Energy standard, IEEE 802 standards (e.g., IEEE 802.11), a ZigBee or similar specification, such as those based on the IEEE 802.15.4 standard, or other public or proprietary protocol. A long-range communication interfaces may be, for example, wide area network (WAN), cellular network interfaces, satellite communication interfaces, etc. The communication interface may be either within a private computer network, such as an intranet, or on a public computer network, such as the internet. Other communication interfaces or protocols can include code division multiple access (CDMA), Global System for Mobile Communications (GSM), Enhanced Data GMS Environment (EDGE), High-Speed Downlink Packet Access (HSDPA), a protocol for email, instant messaging (IM) or text messaging, or a short message service (SMS).

Although in some embodiments the systems and methods disclosed herein may be performed by a temperature sensor operating in a stand-alone manner, in some embodiments at least a portion of the processing of the data, and the reporting of a filter replacement status to a user, may be performed on a computing device that is remote from the temperature sensor. In particularly convenient embodiments the computing device may be a mobile device (e.g. a smartphone or tablet computer) that comprises a software package (i.e. an application, commonly referred to as an "app"). Such an application can perform any one or more of the functions described herein, such as: processing temperature-correlated data to arrive at a Total Runtime Value and adjusting the Total Runtime Value if needed; receiving a Baseline Value and adjusting the Baseline Value if needed; comparing the Total Runtime Value to the Baseline Value; reporting the resulting filter replacement status to a user, and so on. Such an application may also be configured to accept input from a user e.g. in response to a menu or sequence of questions posed by the app to the user. Such input may include, but is not limited to: notification that a new filter has been installed; entry of a temperature setpoint of a thermostat of the HVAC system or of a series of time/temperatures setpoints of a programmable thermostat of the HVAC system; entry of whether the HVAC system is expected to be operating in heating mode, or in cooling mode, or both, in the near future; and, entry of the % time and/or % fan speed at which a fan of a high-efficiency HVAC unit will operate in circulation mode even if the unit is not actively heating or cooling. In general such entries may include any of the environment-related, HVAC-related, or user preference-related parameters discussed earlier herein. Such an application may generate a report of filter status in any of the manners presented herein.

In some embodiments, a temperature sensor as disclosed herein may be long-lived, meaning that it has an expected usable lifetime of e.g. one, two, three years or more. In such cases the temperature sensor may be used to monitor numerous air filters in succession; the methods disclosed earlier herein may be used to input to the processing module that a new air filter has been installed. In other embodiments a temperature sensor may comprise a short usable lifetime; e.g. it may be intended for use only with a single air filter. For example, air filters may be provided to end users, each air filter being accompanied by a single-use temperature sensor.

Although the discussions herein have primarily concerned replacement of air filters that are disposable/recyclable, it will be appreciated that the systems and methods disclosed herein are also applicable to permanently installed (e.g. electrostatic) filters. That is, a report generated as described herein, can prompt a user to remove, clean and replace a cleanable air filter. Thus, the concept of "replacing" a filter encompasses the cleaning and replacement of a permanently installed filter, in addition to the replacing of a disposable/recyclable filter by a new filter. It is again reiterated that while discussions herein have mentioned measuring the "temperature" of air and/or of a register and/or of a supply duct surface, the use of the term "temperature" is used for convenience. It is specifically noted that the systems and methods disclosed herein encompass circumstances in which, for example, the data remains substantially in the form obtained (e.g. as a signal such as a voltage outputted by a temperature-sensitive solid-state diode), rather than being explicitly transformed into an actual temperature. Of course, any such data obtained by the temperature sensor may be smoothed, filtered, subjected to analog-digital conversion, and so on, as will be readily appreciated.

Under certain circumstances, in order to determine the filter replacement status, the processing module may use additional information rather than relying exclusively on the data from the temperature sensor. Such an arrangement may be helpful e.g. in the event that a battery of a temperature sensor expires during a user's extended absence from the dwelling. In these and other situations, it may be possible to supplement the temperature data. Thus in some embodiments, an estimate of the HVAC runtime e.g. for a period in which no data for outputted air temperature is available, may be generated using outdoor weather data as obtained e.g. from an online data service. Exemplary systems and methods for estimating fan runtime based on weather data, and which may be used in combination with the herein-described systems and methods, are described in International Publication No. WO 2016/089688 and in U.S. patent application Ser. No. 15/532,186 (371(c) date 1 Jun. 2017), both of which are incorporated by reference in their entirety herein.

In some embodiments, the systems and methods described herein may be used in combination with, e.g. as an adjunct to, systems and methods that rely on the use of one or more sensors that report one or more parameters representative of a condition of the filter media of the air filter of the HVAC system. In some embodiments such a sensor might be e.g. a pressure sensor that is responsive to pressure drop through the filter media. Systems and methods of this general type are described in U.S. Provisional Application 62/374,040 (filed 12 Aug. 2016) and in International (PCT) Applications PCT/US2017/045508 and PCT/US2017/045492 (both filed 4 Aug. 2017), all of which are incorporated by reference in their entirety herein.

This application is a continuation of U.S. patent application Ser. No. 16/758,351, now allowed, (published as U.S. Patent Application Publication No. 2020/0340698), which was a national stage filing under 35 U.S.C. 371 of PCT Application No. PCT/IB2018/058169 (published as International Publication No. WO2019/082040), which claimed priority to U.S. Provisional Application No. 62/576,165, the disclosures of all of which are incorporated by reference in their entirety herein.

LIST OF EXEMPLARY EMBODIMENTS

Embodiment 1 is a method for estimating a replacement status of an air filter in an HVAC system, the method comprising: obtaining data correlated with the temperature of air outputted by the HVAC system as a function of time; determining a Total Runtime Value of a fan of the HVAC system based upon the obtained data; and estimating a replacement status of the air filter as a function of a comparison of the Total Runtime Value with a Baseline Value.

Embodiment 2 is the method of embodiment 1 wherein the data is obtained by a temperature sensor located in a dwelling served by the HVAC system.

Embodiment 3 is the method of embodiment 1 wherein the data is obtained by a temperature sensor that measures a temperature of a surface of a register that is installed in an outlet of the HVAC system.

Embodiment 4 is the method of embodiment 1 wherein the data is obtained by a temperature sensor that measures a temperature of an external surface of a supply duct of the HVAC system.

Embodiment 5 is the method of embodiment 1 wherein the data is obtained by a temperature sensor located proximate to an outlet of the HVAC system.

Embodiment 6 is the method of embodiment 5 wherein the data is obtained by a temperature sensor that measures the temperature of air exiting the outlet of the HVAC system.

Embodiment 7 is the method of any of embodiments 2-6 wherein the determining the Total Runtime Value of the fan of the HVAC system based upon the obtained data and the estimating a replacement status of the air filter as a function of the comparison of the Total Runtime Value with the Baseline Value, are performed by a processing module that is resident on the temperature sensor.

Embodiment 8 is the method of embodiment 7 wherein the replacement status of the air filter is reported by a reporting module that is resident on the temperature sensor.

Embodiment 9 is the method of any of embodiments 2-6 wherein the data correlated with the temperature of air outputted by the HVAC system is communicated by the temperature sensor to a remote processing module that is not resident on the temperature sensor, and wherein the remote processing module performs the steps of determining the Total Runtime Value of the fan of the HVAC system based upon the obtained data and estimating the replacement status of the air filter as a function of the comparison of the Total Runtime Value with the Baseline Value.

Embodiment 10 is the method of embodiment 9 wherein the replacement status of the air filter is communicated by the remote processing module to a remote reporting module that reports the replacement status of the air filter.

Embodiment 11 is the method of embodiment 10 wherein the remote reporting module is resident on a computing device chosen from a smartphone, laptop computer, tablet computer, and desktop computer.

Embodiment 12 is the method of any of embodiments 2-11 wherein the temperature sensor obtains data intermittently according to a time clock, and wherein the temperature sensor comprises a sleep operating mode from which the temperature sensor awakens intermittently to an interrogation operating mode in order to obtain data.

Embodiment 13 is the method of embodiment 12 wherein the temperature sensor awakens to the interrogation operating mode to obtain data, at a frequency of no less than once every 10 minutes, and no more than once every 30 seconds.

Embodiment 14 is the method of any of embodiments 1-13 wherein the process of determining a Total Runtime Value of the fan of the HVAC system based upon the obtained data correlated with the temperature of air outputted by the HVAC system as a function of time, comprises calculating a total amount of time that a temperature of air outputted by the HVAC system is above a high-temperature threshold value, or is below a low-temperature threshold value.

Embodiment 15 is the method of any of embodiments 1-14 wherein the process of determining a Total Runtime Value of the fan of the HVAC system based upon the obtained data correlated with the temperature of air outputted by the HVAC system as a function of time, comprises a step of calculating a slope of the temperature of air outputted by the HVAC system as a function of time.

Embodiment 16 is the method of any of embodiments 1-15 wherein the Total Runtime Value is an Adjusted Total Runtime Value that includes an Adjustment Addition that is correlated with a length of time that the HVAC is operating in a circulation mode in which the fan of the HVAC system is operating but the HVAC system is not heating or cooling.

Embodiment 17 is the method of any of embodiments 1-16 wherein the Baseline Value to which the Total Runtime Value is compared, is a constant that corresponds to a nominal usable filter life of the air filter.

Embodiment 18 is the method of any of embodiments 1-16 wherein the Baseline Value to which the Total Runtime Value is compared, is a variable that is a function of one or more parameters chosen from the list consisting of: a parameter representative of a level of outdoor airborne particles, a parameter representative of a level of outdoor pollen, a parameter representative of an indoor dust level of a dwelling served by the HVAC system, a parameter representative of an indoor level of pet dander in the dwelling, a parameter representative of an occupancy level of the dwelling, a parameter representative of an indoor level of smoke in the dwelling, a parameter representative of an allergy state of an occupant of the dwelling, and a user preference parameter.

Embodiment 19 is the method of embodiment 18 wherein the one or more parameters are input into the method by a user and are not provided by a sensor that is provided in the dwelling served by the HVAC system.

Embodiment 20 is the method of any of embodiments 1-19 wherein the HVAC system is a residential, on-demand HVAC system.

Embodiment 21 is a system for estimating a replacement status of an air filter in an HVAC system, the system comprising: a sensor configured to be positioned proximate to an outlet of the HVAC system and configured to obtain data correlated with the temperature of air outputted by an HVAC system as a function of time; a processing module configured to determine a Total Runtime Value of a fan of the HVAC system based upon the obtained data and configured to estimate a replacement status of the air filter as a function of a comparison of the Total Runtime Value with a Baseline Value; and, a reporting module configured to receive the replacement status of the air filter from the processing module and to report the replacement status of the air filter to a user.

Embodiment 22 is the system of embodiment 21 wherein the temperature sensor comprises a solid-state temperature-sensing element comprising a temperature-sensitive diode.

It will be apparent to those skilled in the art that the specific exemplary elements, structures, features, details, configurations, etc., that are disclosed herein can be modified and/or combined in numerous embodiments. All such variations and combinations are contemplated by the inventor as being within the bounds of the conceived invention, not merely those representative designs that were chosen to serve as exemplary illustrations. Thus, the scope of the present invention should not be limited to the specific illustrative structures described herein, but rather extends at least to the structures described by the language of the claims, and the equivalents of those structures. Any of the elements that are positively recited in this specification as alternatives may be explicitly included in the claims or excluded from the claims, in any combination as desired. Any of the elements or combinations of elements that are recited in this specification in open-ended language (e.g., comprise and derivatives thereof), are considered to additionally be recited in closed-ended language (e.g., consist and derivatives thereof) and in partially closed-ended language (e.g., consist essentially, and derivatives thereof). To the extent that there is any conflict or discrepancy between this specification as written and the disclosure in any document that is incorporated by reference herein but to which no priority is claimed, this specification as written will control.

What is claimed is:

1. A method for estimating a replacement status of an air filter in an HVAC system, the method comprising:

obtaining data correlated with the temperature of air outputted by the HVAC system as a function of time;

determining a Total Runtime Value of a fan of the HVAC system based upon the obtained data; and estimating a replacement status of the air filter as a function of a comparison of the Total Runtime Value with a Baseline Value.

2. The method of claim 1 wherein the data is obtained by a temperature sensor located in a dwelling served by the HVAC system.

3. The method of claim 1 wherein the data is obtained by a temperature sensor that measures a temperature of a surface of a register that is installed in an outlet of the HVAC system.

4. The method of claim 1 wherein the data is obtained by a temperature sensor that measures a temperature of an external surface of a supply duct of the HVAC system.

5. The method of claim 1 wherein the data is obtained by a temperature sensor located proximate to an outlet of the HVAC system.

6. The method of claim 5 wherein the data is obtained by a temperature sensor that measures the temperature of air exiting the outlet of the HVAC system.

7. The method of claim 1 wherein the replacement status of the air filter is reported by a reporting module that is resident on the temperature sensor.

8. The method of claim 1 wherein the data correlated with the temperature of air outputted by the HVAC system is communicated by the temperature sensor to a remote processing module that is not resident on the temperature sensor, and wherein the remote processing module performs the steps of determining the Total Runtime Value of the fan of the HVAC system based upon the obtained data and estimating the replacement status of the air filter as a function of the comparison of the Total Runtime Value with the Baseline Value.

9. The method of claim 8 wherein the replacement status of the air filter is communicated by the remote processing module to a remote reporting module that reports the replacement status of the air filter.

10. The method of claim 9 wherein the remote reporting module is resident on a computing device chosen from a smartphone, laptop computer, tablet computer, and desktop computer.

11. The method of claim 1, wherein the Baseline Value to which the Total Runtime Value is compared, is a constant that corresponds to a nominal usable filter life of the air filter.

12. The method of claim 1, wherein the Baseline Value to which the Total Runtime Value is compared, is a variable that is a function of one or more parameters chosen from the list consisting of: a parameter representative of a level of outdoor airborne particles, a parameter representative of a level of outdoor pollen, a parameter representative of an indoor dust level of a dwelling served by the HVAC system, a parameter representative of an indoor level of pet dander in the dwelling, a parameter representative of an occupancy level of the dwelling, a parameter representative of an indoor level of smoke in the dwelling, a parameter representative of an allergy state of an occupant of the dwelling, and a user preference parameter.

13. The method of claim 12 wherein the one or more parameters are input into the method by a user and are not provided by a sensor that is provided in the dwelling served by the HVAC system.

14. The method of claim 1, wherein the HVAC system is a residential, on-demand HVAC system.

15. A system for estimating a replacement status of an air filter in an HVAC system, the system comprising:

a sensor configured to be positioned proximate to an outlet of the HVAC system and configured to obtain data correlated with the temperature of air outputted by an HVAC system as a function of time;

a processing module configured to determine a Total Runtime Value of a fan of the HVAC system based upon the obtained data and configured to estimate a replacement status of the air filter as a function of a comparison of the Total Runtime Value with a Baseline Value;

and, a reporting module configured to receive the replacement status of the air filter from the processing module and to report the replacement status of the air filter to a user.

16. The system of claim 15 wherein the temperature sensor comprises a solid-state temperature-sensing element comprising a temperature-sensitive diode.

17. The system of claim 15 wherein the processing module is configured so that the determining of the Total Runtime Value of the fan of the HVAC system based upon the obtained data correlated with the temperature of air outputted by the HVAC system as a function of time, comprises calculating a total amount of time that a temperature of air outputted by the HVAC system is above a high-temperature threshold value, or is below a low-temperature threshold value.

18. The system of claim 15 wherein the processing module is configured so that the determining of the total Runtime Value of the fan of the HVAC system based upon the obtained data correlated with the temperature of air outputted by the HVAC system as a function of time, comprises a step of calculating a slope of the temperature of air outputted by the HVAC system as a function of time.

19. The system of claim 15 wherein the Total Runtime Value is an Adjusted Total Runtime Value that includes an Adjustment Addition that is correlated with a length of time that the HVAC is operating in a circulation mode in which the fan of the HVAC system is operating but the HVAC system is not heating or cooling.

20. The system of claim 15 wherein the sensor is configured to measure the temperature of air exiting the outlet of the HVAC system.

* * * * *